US005434785A

United States Patent [19]

Myeong-hün et al.

[11] Patent Number: 5,434,785

[45] Date of Patent: Jul. 18, 1995

[54] SYSTEM FOR AUTOMATICALLY CONTROLLING QUANTITY OF HYDRAULIC FLUID OF AN EXCAVATOR

[75] Inventors: Song Myeong-hün, Namgu; Lee Jin-han, Chungcheongnam-do; Jeong Sang-tae, Seoul, all of Rep. of Korea

[73] Assignee: Samsung Heavy Industries Co., Ltd., Changwon, Rep. of Korea

[21] Appl. No.: 791,559

[22] Filed: Nov. 14, 1991

[30] Foreign Application Priority Data

Nov. 24, 1990 [KR] Rep. of Korea ..... 90-19124
Dec. 29, 1990 [KR] Rep. of Korea ..... 90-22383

[51] Int. Cl.[6] ..... G06F 17/00; E02F 3/28

[52] U.S. Cl. ..... 364/424.07; 37/902; 340/684; 414/687

[58] Field of Search ..... 364/424.07; 414/682, 414/685, 687–695, 699, 700; 37/902; 340/684, 686

[56] References Cited

U.S. PATENT DOCUMENTS

| | | | |
|---|---|---|---|
| 3,934,126 | 1/1976 | Zalesov et al. | 364/424.07 |
| 4,332,517 | 6/1982 | Igarashi et al. | 414/699 |
| 4,377,043 | 3/1983 | Inui et al. | 364/424.07 X |
| 4,791,549 | 12/1988 | Heiser et al. | 414/700 X |
| 4,805,086 | 2/1989 | Nielsen et al. | 364/167.01 |
| 4,807,136 | 2/1989 | Rutkowski et al. | 364/424.07 |
| 4,844,685 | 7/1989 | Sagaser | 414/700 |
| 4,866,641 | 9/1989 | Nielsen et al. | 364/424.07 X |
| 5,065,326 | 11/1991 | Sahm | 364/424.07 |

*Primary Examiner*—Kevin J. Teska
*Assistant Examiner*—Collin W. Park
*Attorney, Agent, or Firm*—Price, Heneveld, Cooper, DeWitt & Litton

[57] ABSTRACT

A control system for controlling quantity of hydraulic fluid of an excavator. The control system of this invention provides a method for controlling the quantity of the hydraulic fluid supplied to the swing motor in which in case of swinging operation for driving the swing motor in order to turn the upper frame with respect to the lower frame, the first hydraulic pump is automatically controlled by the controller in order to optimally output hydraulic fluid to timely correspond to starting of the practical swinging operation of the swing motor. The control system of this invention provides another control method for controlling the main pumps in order to output minimum quantity of fluid flow in case of sensing an abnormal operational speed, a speed not exceeding ½, speed of the minimum operational speed of the actuator occurring when the actuator is supplied with the minimum quantity of the hydraulic fluid from the main hydraulic pumps, occurring on the actuators due to an overload, but output a normal quantity of fluid flow in order to allow the actuators to be normally operated in case sensing a returnable speed, a speed exceeding ¾ speed of the minimum operational speed.

1 Claim, 4 Drawing Sheets

SYSTEM FOR AUTOMATICALLY CONTROLLING QUANTITY OF HYDRAULIC FLUID OF AN EXCAVATOR

BACKGROUND OF THE INVENTION

1. Field of The Invention

The present invention relates to a control system for an excavator, and more particularly to a system for automatically controlling quantity of hydraulic fluid of the excavator in which main hydraulic pumps thereof are automatically control led in order to output optimal quantity of the hydraulic fluid outputted therefrom to a swing motor during a swinging operation, and also output minimum quantity of hydraulic fluid therefrom to actuators in case of an overload occurring on the actuators.

2. Description of the Prior Art

Conventionally, known excavators are provided with a plurality of actuators which are actuated by hydraulic power and comprise a driving motor section comprising a swing motor for swinging an upper frame including a control cab with respect to a lower frame provided with travelling members, such as crawlers, and travel ling motors for travelling the excavators, and an actuating cylinder section comprising a dipper cylinder for driving a dipper stick, a boom cylinder for driving a boom and a bucket cylinder for driving a bucket. The above actuators are controlled by virtue of manipulating control levers/pedals provided in the cab and manipulated by the operator in order to efficiently carry out several operations of the excavator such as excavating operations, surface finishing operations, loading operations and the like.

However, the known excavators have the following disadvantages resulting in fatigue of the operator in order to deteriorate the operational effect of the excavator, and causing the operational energy to be unnecessarily lost.

First, the excavator often carries out the swinging operation in which the swing motor is driven by virtue of manipulation for the swing lever, thereby swinging the upper frame with respect to the lower frame. At this time, a main hydraulic pump connected to a directional control valve of the swing motor outputs, in accordance with a control signal outputted from a controller, the quantity of hydraulic fluid to the swing motor by way of the directional control valve. Here, as the swing motor control lever is manipulated, the quantity of the hydraulic fluid outputted from the main pump to the swing motor is varied as described at the characteristic curves of a graph of FIG. 5.

Referring to the graph, it is known that as the swing motor control lever is manipulated, the main pump outputs considerable quantity of the hydraulic fluid to the swing motor before the upper frame of the excavator swings with respect to the lower frame so that the quantity of the hydraulic fluid represented at the deviant lines of the graph is lost, thereby causing the operational energy to be lost. The reason why the main pump outputs considerable quantity of the hydraulic fluid to the swing motor before starting of the swinging action of the swing motor is that upon receiving respective control signals from the controller at the same time, the swing motor can not swing the upper frame of the excavator with respect to the lower frame due to weight of the upper frame but the main pump outputs at once the required quantity of the hydraulic fluid to the swing motor.

Therefore, the operator has to minutely manipulate the swing control lever in order to control the outputting operation of the hydraulic fluid of the main hydraulic pump to correspond to the practical swinging operation of the swing motor as described at the characteristic curves of the graph of FIG. 5, so that the hydraulic fluid outputted from the main pump is not unnecessarily lost.

However, it is required great skill for the operator to control the swing operation of the excavator not to dissipate the hydraulic fluid. In result, the known excavators have a disadvantage in that such a minute operation causes fatigue of the operator in a long time operation, thereby causing the operational effect of the excavator to deteriorate, and a safety accident to occur during the swinging operation. In addition, the known excavators have another disadvantage in that the minute swinging operation for preventing operational energy loss can not be carried out completely even by a skilled operator so that a part of quantity of hydraulic fluid is unnecessarily lost as before.

Second, the known excavator is equipped, as described above, with a plurality of actuators, such as the travelling motors, the cylinder actuators and the swing motor. The known excavator is also provided with the main hydraulic pumps for supplying the hydraulic fluid for the actuators in order to drive them. However in case of occurrence of overload on the actuators, the actuators automatically stop their operations at once, while the main hydraulic pumps continuously output hydraulic fluid to the actuators. In result, the hydraulic fluid continuously outputted from the main pumps to the actuators is not used for driving the actuators as the actuators stop their operations due to the overload occurring thereon but directly drains into a drain tank, thereby causing the main hydraulic pumps to be unnecessarily driven by the engine. Therefore, the known excavators have a disadvantage in that in case of occurring an overload on an actuator, resulting in stopping the operation thereof, the driving power for driving the engine to continuously drive the main pumps is unnecessarily dissipated. SUMMARY OF THE INVENTION Therefore, the present invention is accomplished in order to overcome the above disadvantages.

It is an object of the present invention to provide a system for automatically controlling quantity of hydraulic fluid of an excavator in which in case of swinging operation for driving a swing motor in order to turn an upper frame of the excavator with respect to a lower frame thereof, a hydraulic pump is automatically controlled by an electric controller in order to optimally output hydraulic fluid to timely correspond to starting of a practical swinging operation of the swing motor, thereby reducing a hydraulic fluid loss as possible as, and accomplishing a smooth and rapid swinging operation by a simple manipulation for a swing motor control lever without occurrence of mechanical shock on the main pump or the swing motor.

It is another object of the present invention to provide a system for automatically controlling quantity of hydraulic fluid of an excavator in which in case of sensing a relatively slower operational speed of an actuator which is lower than ½ speed of a minimum operational speed Vain of the actuator occurring when the actuator is supplied with a minimum quantity of the hydraulic fluid from the main hydraulic pumps, the electric controller outputs a control signal of a minimum current value to wobbling angle control valves of the main hydraulic pumps in order to minimize the wobbling angles of the wobbling plates of the main hydraulic pumps so as to minimize the quantity of the hydraulic fluid outputted from the pumps to the actuator, while in case of sensing a returnable speed of the actuator which is higher than $\frac{3}{4}$ speed of a minimum operational speed Vmin of the actuator, thereby causing the driving power for driving an engine to be efficiently prevented from being lost due to an overload occurring on the actuators.

In one aspect, the above objects of the present invention can be accomplished by providing in an apparatus for automatically controlling quantity of hydraulic fluid of an excavator comprising a plurality of actuators comprising a boom cylinder for actuating a boom, a dipper cylinder for actuating a dipper stick, a bucket cylinder for actuating a bucket, a swing motor for swinging an upper frame of the excavator with respect to a lower frame thereof and travelling motors for travel ling said excavator; an electronic controller for controlling the operation of said actuators; main hydraulic pumps for supplying hydraulic fluid for said actuators; a sub-hydraulic pump for supplying pilot hydraulic fluid; a plurality of directional control valves each connected to said main hydraulic pumps and said electronic controller for controlling operational direction of said actuators and also quantity of said hydraulic fluid flow; pilot valve blocks adapted to controllably move spools of said directional control valves in accordance with electric control signals outputted from said electronic controller; wobbling angle control valves disposed between the controller and the main pumps for controlling wobbling angles of the main hydraulic pumps in order to control said quantity of hydraulic fluid flow outputted therefrom; positional sensors provided at respective actuators in order to sense positional displacement values of said actuators; control levers/pedals for outputting respective electric signals corresponding to handling values for actuators to the controller; and a plurality of amplifiers disposed among the controller and said pilot valve blocks and said wobbling angle control valves; respectively, for amplifying electric signals outputted from said controller to said pilot valve blocks and said wobbling angle control valves; said controller comprising: a CPU for processing input analog signals in order to output control signals; an analog/digital signal converter for converting the input analog signals corresponding to manipulation values applied from the control levers/pedals to the controller into digital signals; an analog/digital signal converter/counter for converting and counting an input signal corresponding to a swinging positional value of the swing motor applied from a positional sensor of tile swing motor; first and second digital/analog signal converters for converting digital control signals from the CPU into analog control signals for controlling the spools of the directional control valves of the actuators in accordance with the manipulating values of the control levers/pedals; a third digital/analog signal converter for converting digital control signals from the CPU into analog control signals for additional output quantity of fluid flow and target output quantity of fluid flow; and signal amplifiers electrically connected to the digital/analog signal converters, respectively.

In another aspect, the above objects of the present invention can be accomplished by providing in an excavator comprising actuators including a boom cylinder for actuating a boom, a dipper cylinder for actuating a dipper stick, a bucket cylinder for actuating a bucket, a swing motor for swinging an upper frame of the excavator with respect to a lower frame thereof and travelling motors for travelling said excavator, a control process for automatically controlling a control apparatus for controlling the quantity of hydraulic fluid of the excavator comprising an electronic controller for controlling the operation of said actuators; main hydraulic pumps for supplying hydraulic fluid for said actuators; a sub-hydraulic pump for supplying pilot hydraulic fluid; a plurality of directional control valves each connected to said main hydraulic pumps and said electronic controller for controlling operational direction of said actuators and also quantity of said hydraulic fluid flow; pilot valve blocks adapted to controllably move spools of said directional control valves in accordance with electric control signals outputted from said electronic controller; wobbling angle control valves disposed between the controller and the main pumps for controlling wobbling angles of the main hydraulic pumps in order to control said quantity of hydraulic fluid flow outputted therefrom; positional sensors provided at respective actuators in order to sense positional displacement values of said actuators; control levers/pedals for outputting respective electric signals corresponding to handling values for actuators to the controller; and a plurality of amplifiers disposed among the controller and said pilot valve blocks and said wobbling angle control valves; respectively, for amplifying electric signals outputted from said controller to said pilot valve blocks and said wobbling angle control valves; the control process further comprising the steps of: upon receiving a manipulation value from the control levers/pedals, determining whether the manipulation value for the control levers/pedals is only for the swing motor in order to perform a swinging operation; upon receiving a swing positional value of the swing motor from the swing motor positional sensor, calculating a target output quantity of fluid flow of the main hydraulic pump in accordance with the manipulation value of the swing motor control lever, and calculating a practical quantity of hydraulic fluid flow of the main pump on the basis of the swing positional value of the swing motor, thereafter comparing the target output quantity of the fluid flow with the practical quantity of the fluid flow in order to calculate a difference therebetween; and upon determining whether the difference is not zero, calculating an additional output quantity of fluid flow for the practical quantity of the fluid flow and an additional target output quantity of fluid flow in order to satisfy a desired swing operation according to the manipulation values of the swing lever control lever, thereafter outputting an electric control signal corresponding to the additional target output quantity of fluid flow to the wobbling angle control valve of the main hydraulic pump.

In still another aspect, the above objects of the present invention can be accomplished by providing a control process comprising the steps of: upon receiving operational speed of an actuator from a positional sensor thereof, determining whether the actuator is normally driven; if the actuator is not normally driven, determining whether the operational speed of the actuator is not exceeding $\frac{1}{2}$ speed of a minimum operational speed of the actuator, said minimum operational speed occurring when the actuator is supplied with a minimum quantity of the hydraulic fluid from the main hydraulic pump; if the operational speed of the actuator is not exceeding the ½ speed of the minimum operational speed, outputting a minimum current value to the wobbling angle control valve in order to minimize the wobbling angle of the main pump, thereby making the main pump to output a minimum quantity of fluid flow to the actuator; if the actuator is normally driven, determining whether the operational speed of the actuator is equal to or exceeds ¾ speed of the minimum operational speed of the actuator; and if the operational speed of the actuator is equal to or exceeds the ¾ speed of the minimum operational speed, outputting an electric control signal to the wobbling angle control valves in order to allow the main pumps to output quantity of fluid flow according to the manipulation values of the control levers/pedals.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
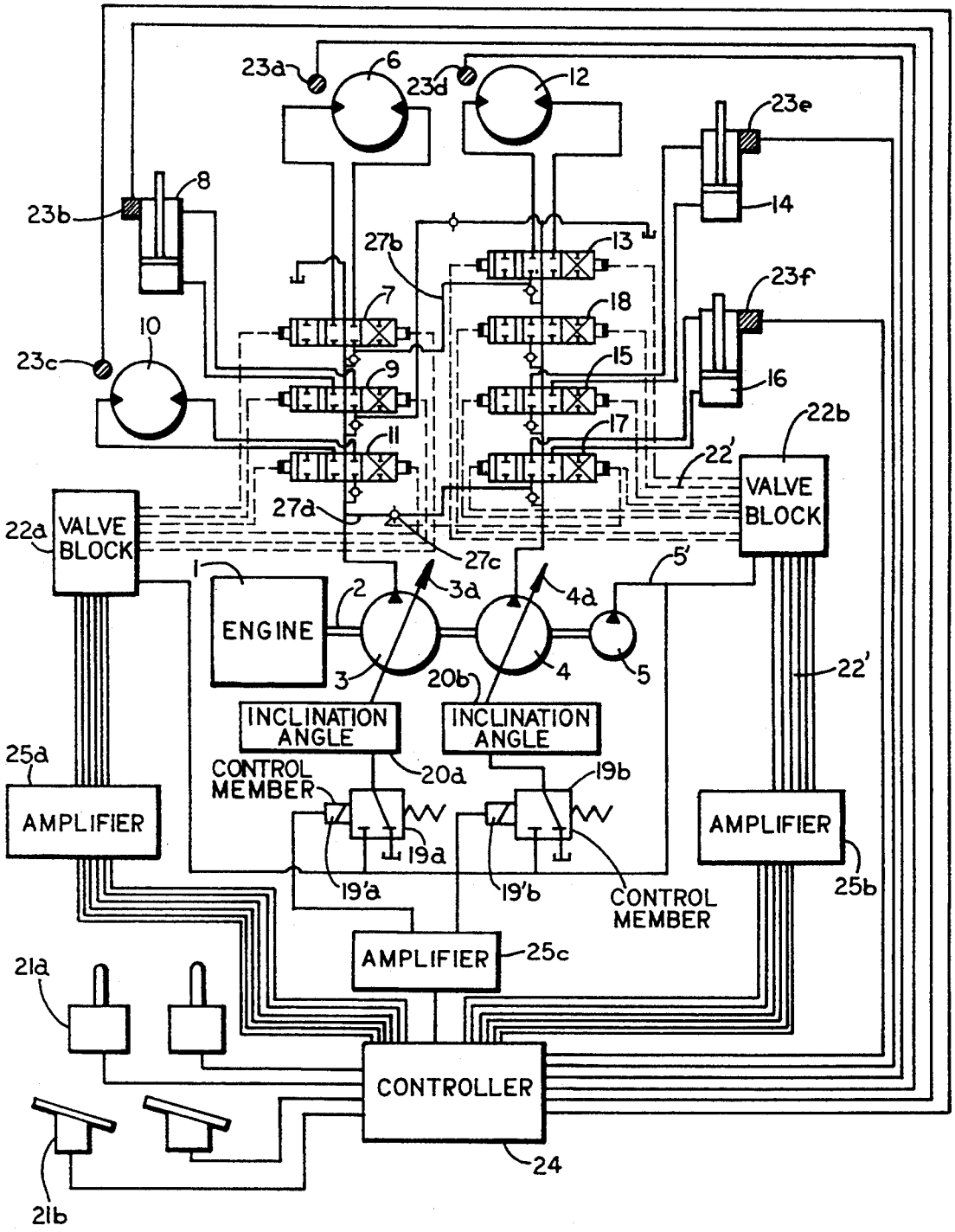
FIG. 1 is a schematic circuit diagram showing a basic hydraulic circuit of a control system for automatically controlling quantity of hydraulic fluid of an excavator in accordance with the present invention.

Referring now to FIG. 1 which is a basic hydraulic circuit of a control system of this invention, the basic hydraulic circuit includes a driving engine 1 for generating a driving power for driving a pair of main hydraulic pumps of the excavator, first and second main hydraulic pumps 3 and 4 sequentially and straightly connected to a driving shaft 2 of the engine 1 and each comprising a wobble plate pump. The second main pump 4 is straightly connected to a sub-hydraulic pump or a third pump 5 having a relatively smaller capacity than those of the first and second main pumps 3 and 4 and adapted for outputting a pilot hydraulic fluid.

The first main pump 3 is, as shown in the drawl straightly connected to a first group of directional control valves in order to be communicated therebetween, for example a first directional control valve 7 for controlling a flow direction and quantity of hydraulic fluid outputted from the pump 3 to a left travelling motor 6 adapted for driving the left side crawler of the excavator, a second directional control valve 9 for controlling hydraulic fluid supplied for a dipper cylinder 8 adapted for driving a dipper stick, and a third directional control valve 11 for controlling hydraulic fluid supplied for a swing motor 10 adapted for swinging the upper frame provided with tile control cab with respect to the lower frame provided the crawlers.

In the same manner, the second main pump 4 is straightly connected to a second group of directional control valves in order to provide a fluid communication therebetween, for example a fourth directional control valve 13 for controlling a flow direction and quantity of hydraulic fluid outputted from the pump 3 to a right travelling motor 12 adapted for driving the right side crawler of the excavator, a fifth directional control valve 15 for controlling hydraulic fluid supplied for a bucket cylinder 14 adapted for driving a bucket, a sixth directional control Valve 17 for controlling hydraulic fluid supplied for a boom cylinder 16 adapted for driving a boom, and a preparatory directional control valve 18 for controlling hydraulic fluid supplied for an auxiliary actuator (not shown) which may be equipped in the excavator as required.

Additionally, the hydraulic fluid outputted from the third hydraulic pump 5 having the relatively smaller capacity than those of the first and second main pumps 3 and 4 is used as a pilot hydraulic fluid for actuating the wobble plates 3*a* and 4*a* of the first and second main pumps 3 and 4 and a spool of each directional control valve 7, 9, 11, 13, 15, 17, 18. In other words, a part of the pilot hydraulic fluid from the third pump 5 is communicated through a fluid passage with a pair of wobbling angle control members 20*a* and 20*b*, each adapted for controlling the wobbling angle of the wobble plate 3*a*, 4*a* of the main pump 3, 4, by way of a pair of wobbling angle control valves 19*a* and 19*b* which each comprises a proportional valve provided with a solenoid 19'*a*, 19'*b*. The other part of the pilot hydraulic fluid from the third pump 5 is communicated through another fluid passage with each spool of the directional control valve 7, 9, 11, 13, 15, 17, 18 by way of a pair of electronic proportional valve blocks 22*a* and 22*b* each connected to the directional control valve 7, 9, 11, 13, 15, 17, 18 and also a controller 24 through a control line, and actuated under the control of the controller 24 in accordance with manipulation of the control levers/pedals 21 provided i n the cab.

Also, the control levers/pedals 21 comprises the same number of levers/pedals 21 as those of the directional control valves 7, 9, 11, 13, 15, 17 and 18, that is the number of actuators 6, 8, 1 0, 12, 14 and 16. Also, the proportional pilot solenoid valve blocks 22*a* and 22*b* each includes therein the same number of proportional pilot valves (not shown) as those of a group of directional control valves 7, 9 and 11 or 13, 15, 17 and 18 connected to the corresponding valve block 22*a*, 22*b*. Therefore, a control lever/pedal 21 for an actuator which is to be actuated is manipulated in order to proportionally drive a proportional pilot solenoid valve provided in the valve block 22*a*, 22*b* for the control lever/pedal 21. Thus, the pilot hydraulic fluid outputted from the third pump 5 is supplied to a directional control valve 7, 9, 11, 13, 15, 17, 18 corresponding to the actuator which is to be actuated. Therefore, the spool of the directional control valve 7, 9, 11, 13, 15, 17, 18 supplied with the pilot hydraulic fluid from the third pump 5 moves rightwards or leftwards in order to last actuate the operating members, such as the bucket, the dipper stick or the like, in a desired direction.

As shown in FIG. 1, the hydraulic circuit is additionally provided with a plurality of sensors 23*a* to 23*f* for sensing positional displacement of the actuators 6, 8, 10, 12, 14 and 16 according to operation of the actuators. The sensors 23*a* to 23*f* are mounted to the actuators, respectively. Thus, the sensors 23*a* to 23*f* comprise the same number of sensors as that of the actuators. Also, the sensors 23*a* to 23*f* is electrically connected to the controller 24 so as to output a signal representing the displacement of the subject actuator to the controller 24.

On the other hand, a pair of amplifiers 25*a* and 25*b* each is electrically connected to the pilot proportional valve block 22*a*, 22*b* and the controller 24 so as to be disposed therebetween, while another amplifier 25*c* is electrically connected to the wobbling angle control valves 19*a* and 19*b* and the controller 24 so as to be disposed therebetween. The controller 24 is electrically connected to the positional displacement sensors 23*a* to 23*f*.

The positional displacement sensors 23*a* to 23*f* may comprise several types of known sensors. For example, the sensors 23*b*, 23*e* and 23*f* mounted to the dipper cylinder 8, the bucket cylinder 14 and the boom cylinder 16, respectively, each may comprise a sensor which comprises a variable resistance potentiometer and magnetic materials so as to output an electric signal resulting from counting the number of magnetic materials. In the same manner, the sensor 23*c* of the swing motor 10 may comprise an absolute type encoder capable of sensing the absolute position of the upper frame with respect to the lower frame of the excavator, while the sensors 23*a* and 23*d* mounted to the travelling motors 6 and 12 each may comprise an incremental encoder.

Also, each amplifier 25*a* 25*b*, 25*c* electrically connected to the output port of the controller 24, is adapted for amplifying a control signal outputted from the controller 24 and applying the amplified signal to the pilot valve block 22*a*, 22*b* or the wobbling angle control valves 19*a* and 19*b*. In other words, an electric current generated in accordance with the manipulating displacement value of the control levers/pedals 21 is applied to the controller 24 in order to be calculated and allow the controller 24 to output a control signal which is amplified by the amplifiers 25*a* and 25*b* each disposed between the controller 24 and the pilot valve blocks 22*a* and 22*b*. Thereafter, the control signal is applied to the valve blocks 22*a* and 22*b* so as to control a flow direction and quantity of the pilot hydraulic fluid flow outputted from the third hydraulic pump 5 to the spools of respective directional control valves 7, 9, 11, 13 15 17 and 18. Also, the sensors 23*a* to 23*f* each outputs a signal representing the positional displacement value of each actuator 6, 8, 10, 12, 14, 16 sensed thereby to the controller 24. The controller 24 then operates the displacement value of the actuators on the basis of respective load occurring on the actuators and the required quantity of hydraulic fluid flow for the actuators so as to adjustable control the first and second main pumps 3 and 4, thereby allowing the first and second main pumps 3 and 4 to equally charge an overload in case of occurrence of the overload on an actuator.

Figure 2:
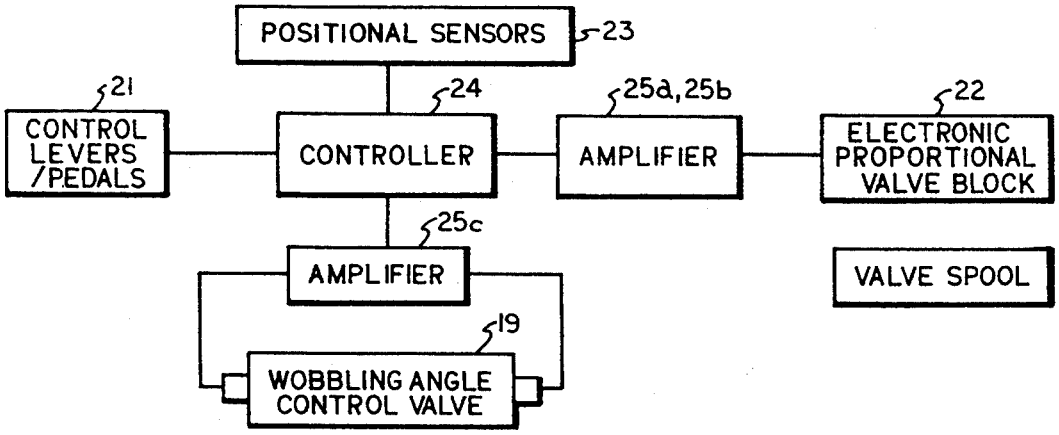
FIG. 2 is a block diagram showing a construction of the control system of FIG. 1.

On the other hand, FIG. 2 is a block diagram showing a construction of the control system of FIG. 1.

The control system having the above mentioned construction provides a method for automatically controlling, in case of swinging operation for driving a swing motor in order to turn an upper frame of the excavator with respect to a lower frame thereof, hydraulic pumps in order to optimally output hydraulic fluid to timely correspond to starting of a practical swinging operation of the swing motor, thereby reducing a hydraulic fluid loss as possible as, and accomplishing a smooth and rapid swinging operation by a simple manipulation for a swing motor control lever without occurrence of mechanical shock on the main pump or the swing motor. The above control method will be described in detail in conjunction with the accompanying drawings.

Figure 3:
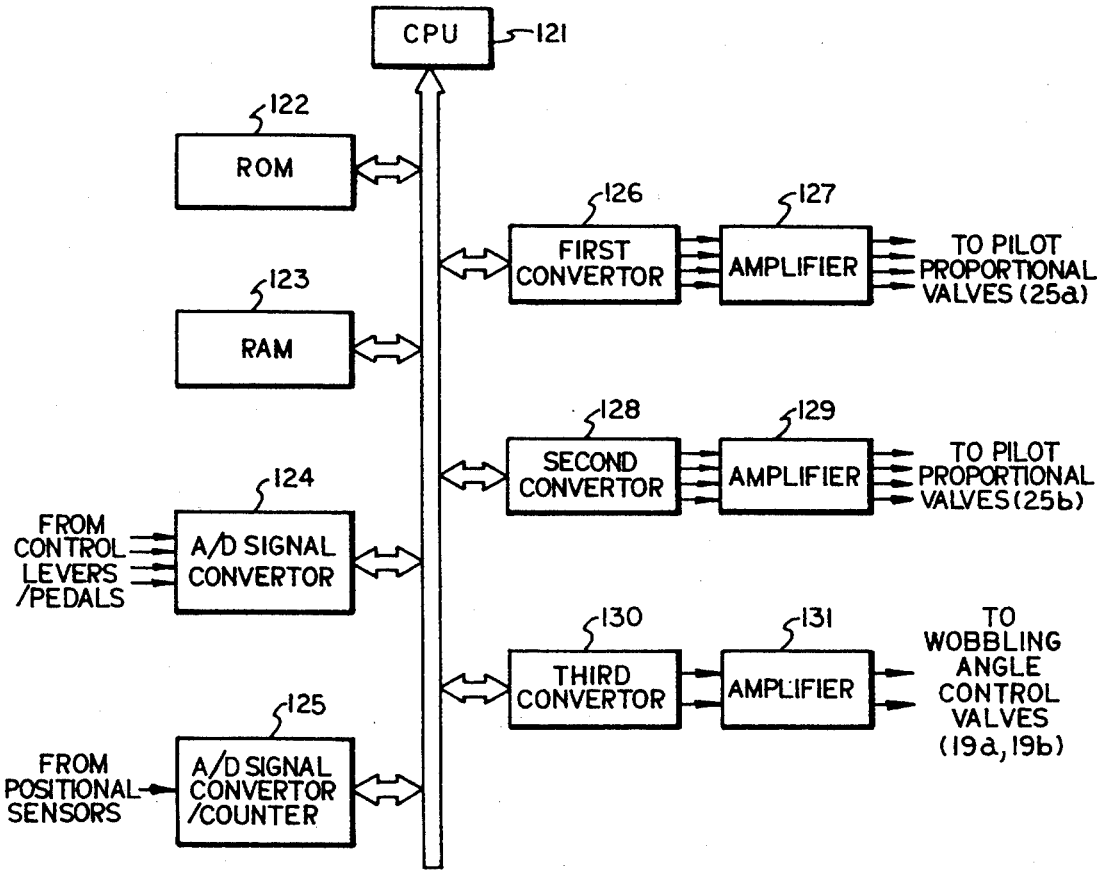
FIG. 3 is a block diagram showing a construction of the electronic controller of FIG. 1.

Referring to FIG. 3 which is a block diagram showing a construction of the electronic controller of FIG. 1, the controller 24 comprises a CPU 121 for processing input signals in order to output control signals, an input part and an output part. The input part of the controller 24 comprises an analog/digital signal converter 124 for converting input analog signals corresponding to manipulation values $\Theta_i$ applied from the control levers/pedals 21 to the controller 24 into digital signals, an analog/digital signal converter/counter 125 for converting and counting an input signal corresponding to a swinging positional value $\Theta_{SW}$ of the swing motor 10 applied from a positional sensor 23*c* of the swing motor 10. On the other hand, the output part of the controller 24 comprises three digital/analog signal converter, first and second converters 126 and 128 for converting digital control signals from the CPU 121 into analog control signals for controlling spools of the directional control valves of actuators in accordance with manipulating values $\Theta_i$ of the control levers/pedals 21, and a third converter 130 for converting digital control signals from the CPU 121 into analog control signals for additional output quantity of fluid flow $\delta Q$ and target output quantity of fluid flow $Q_0$. In result, the signal converter 124 is electrically connected to the control levers/pedals 21 and the signal converter/counter 125 is electrically connected to the positional sensors 23. In the same manner, the signal converters 126, 128 and 130 are connected to the proportional control solenoid valves 25*a*, 25*b* and 19 by means of signal amplifiers 127, 129 and 131, respectively. In addition, the controller 24 is provided with a ROM 122 and a RAM 123.

Figure 4:
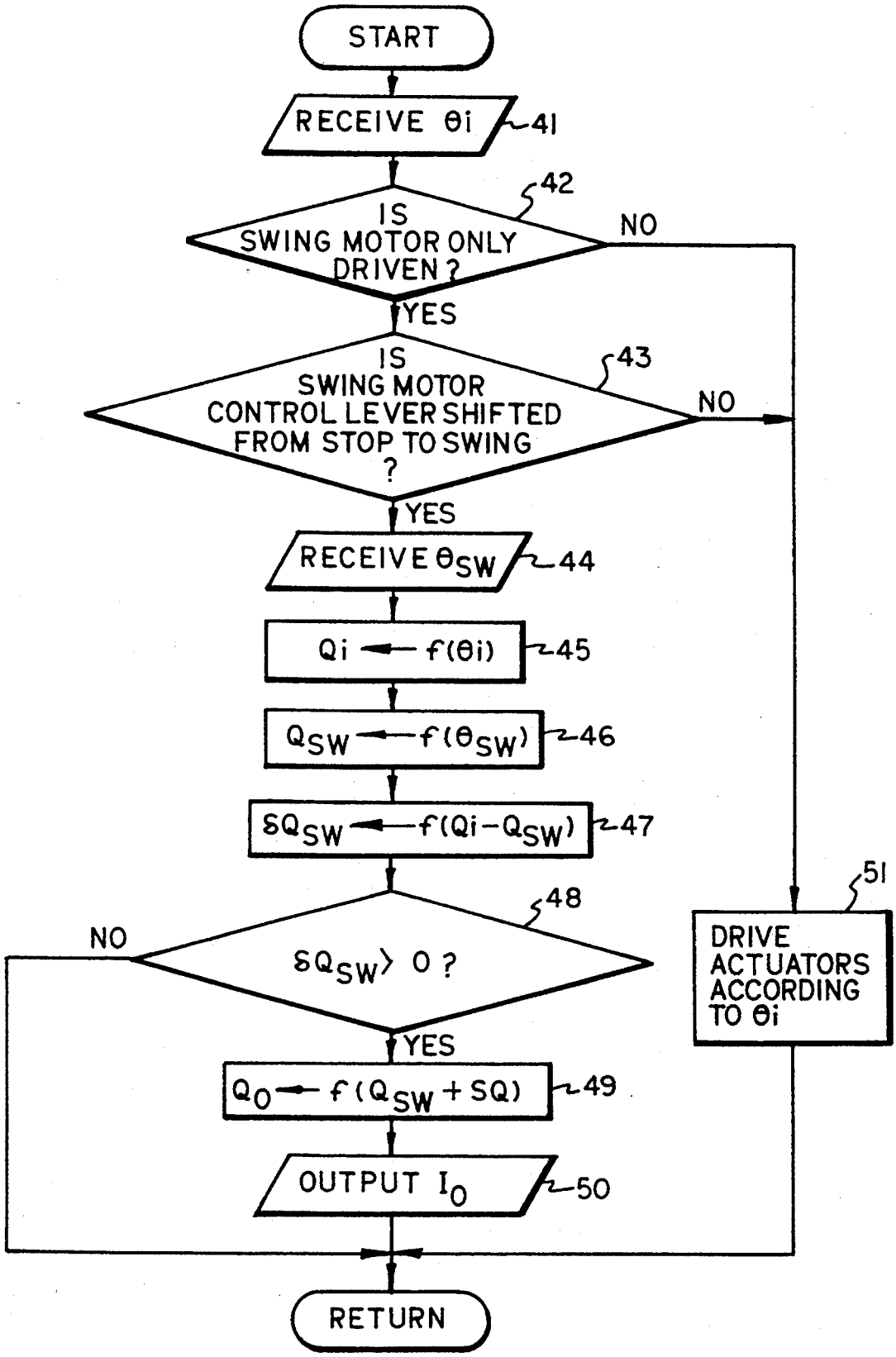
FIG. 4 is a flow chart showing a control method for automatically controlling the quantity of the hydraulic fluid from the main hydraulic pumps in case of a swinging operation in accordance with this invention.

Referring next to FIG. 4 which is a flow chart showing a control method for automatically controlling the quantity of the hydraulic fluid from the main hydraulic pumps in case of a swinging operation in accordance with this invention, the controller receives at a step 41 input signals corresponding to manipulation values $\Theta_i$ from the control levers/pedals 21 by means of the analog/digital signal converter 124, and determines at a first inquiry step 42 whether the manipulation for the control levers/pedals 21 is only for the swing motor 10 in order to perform a swinging operation. If the manipulation for the control levers/pedals 21 is only for the swing motor 10, the controller 24 performs a next step 43 wherein it is determined whether the swing motor 10 starts its swing operation by means of shifting of the swing motor control lever 10 from the neutral position to the swing position, while the controller 24 normally controls at step 51 respective operations of the actuators in accordance with the manipulation values $\Theta_i$ if the manipulation for the control levers/pedals 21 is not only for the swing motor 10. At the step 43, if the swing motor 10 starts its swing operation, the controller 24 receives at a step 44 an electric signal corresponding to a swing positional value $\Theta_{SW}$ of the swing motor from the swing motor positional sensor 23c by way of the signal converter/counter 125. However, if the swing motor 10 does not start its swing operation, the controller 24 performs the step 51 in order to normally control respective operations of the actuators in accordance with the manipulation values $\Theta_i$. Here, the signal converter/counter 125 comprises an absolute type encoder which outputs a pulse signal corresponding to a swinging position of the upper frame with respect to the lower frame.

The controller 24 then calculates at a next step 45 each target output quantity of fluid flow $Q_i$ of the main hydraulic pump 3, 4 in accordance with each manipulation value $\Theta_i$ of the swing motor control lever 21. Thereafter, at a step 46 a swinging speed $W_{SW}$ of the swing motor 10 is calculated in accordance with the practice manipulation values, and a practical quantity of hydraulic fluid flow $Q_{SW}$ of the main pump 3, 4 is calculated on the basis of the swinging speed $W_{SW}$ of the swing motor 10. The controller 24 then performs a step 47 wherein the target output quantity of the fluid flow $Q_i$ according to the manipulation values $\Theta_i$ is compared with the practical quantity of the fluid flow $Q_{SW}$ in order to calculate a difference $\delta Q_{SW}(=Q_i-Q_{SW})$.

Figure 5:
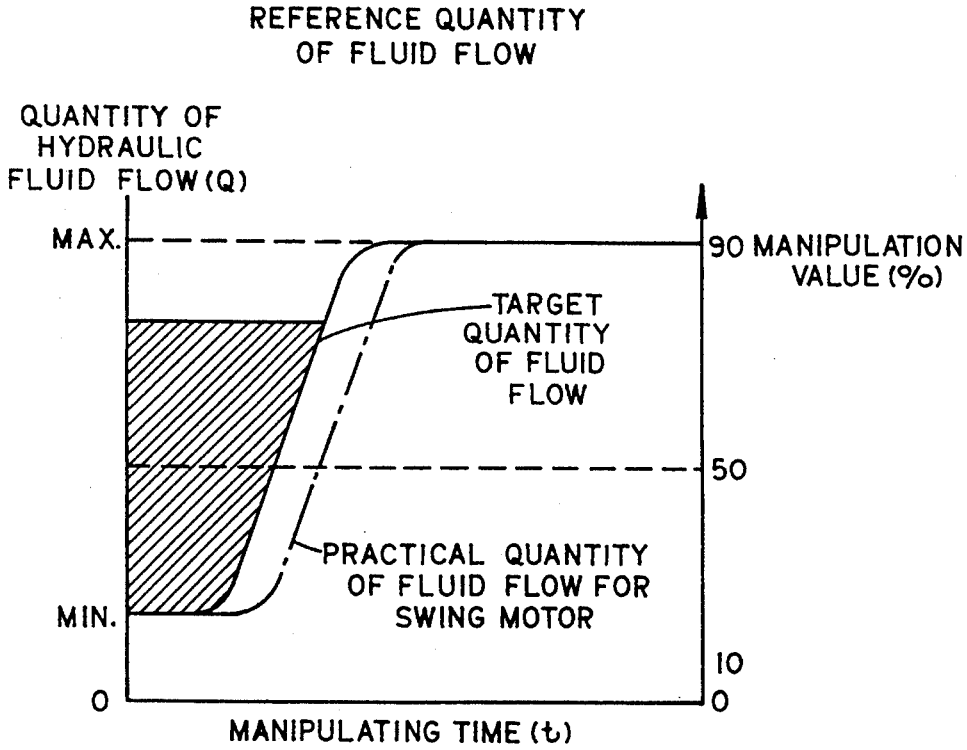
FIG. 5 is a graph showing a characteristic curves of variation of the quantity of hydraulic fluid outputted from the main hydraulic pumps on the basis of a time for manipulation of the control levers/pedals.

The controller 24 then performs a next inquiry step 48 wherein it is determined whether the difference $\delta Q_{SW}$ is not zero. If the difference $\delta Q_{SW}$ is not zero, it is considered that there is a difference between two quantity of fluid flow $Q_i$ and $Q_{SW}$ so that the controller 24 calculates at step 49 an additional target output quantity of fluid flow $Q_0$ in order to satisfy the desired swing operation according to the manipulation values $\Theta_i$ of the swing lever control lever 21, while the controller 24 simply stop the control process if the difference $\delta Q_{SW}$ is zero. The additional target output quantity of fluid flow $Q_0$ is calculated by having first calculated an additional output quantity of fluid flow $\delta Q$ for the practical quantity of the fluid flow $Q_{SW}$ as described at the graph of FIG. 5, then adding the additional output quantity of fluid flow $\delta Q$ to the practical quantity of the fluid flow $Q_{SW}$.

Thereafter, the controller 24 outputs an electric control signal $I_0$ corresponding to the additional target output quantity of fluid flow $Q_0$ to the wobbling angle control valve 19a of the first main hydraulic pump 3 by way of the third digital/analog signal converter 130 and the third signal amplifier 25c. In result, the first main pump 3 changes wobbling angle of its wobbling plate 3a in order to output the additional target output quantity of fluid flow $Q_0$. At this time, the controller outputs another electric control signal to the spool of the swing motor directional control valve 11 by way of the first digital/analog signal converter 126 and the first signal amplifier 25a. Hence, the directional control valve 11 controls the flow direction and the quantity of the hydraulic fluid flow outputted from the first main pump 3, thereby allowing the swing motor to be driven in order to swing the upper frame with respect to the lower frame in accordance with the manipulation value $\Theta_i$ of the swing motor control lever 21.

The above mentioned process is repeated until the practical quantity of the fluid flow $Q_{SW}$ according to the practical swinging speed $W_{WS}$ of the swing motor 10 is equal to the target output quantity of fluid flow $Q_i$ of the main hydraulic pump 3 according to the manipulation value $\Theta_i$ of the swing motor control lever 21. Thus, the quantity of hydraulic fluid flow outputted from the first main hydraulic pump 3 to the swing motor 10 is automatically controlled in order to correspond to the practical swinging speed of the swing motor 10, thereby efficiently preventing an energy loss due to outputting of hydraulic fluid from the main pump to the swing motor before starting of swinging of the swing motor.

In addition, the control system of this invention provides aa control method for automatically controlling the quantity of the hydraulic fluid outputted from the main hydraulic pumps to actuators in order to be minimized in case of overload occurring on the actuators. The method will be described in detail in conjunction with the accompanying drawing.

Figure 6:
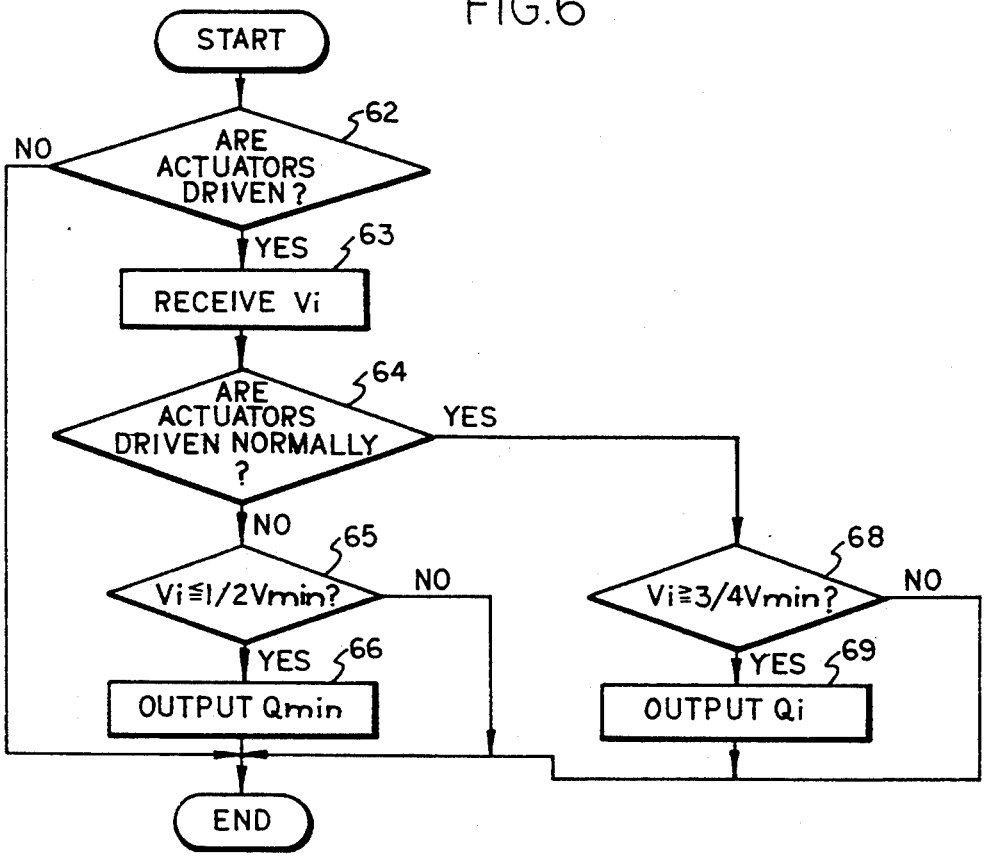
FIG. 6 is a flow chart showing a control method for automatically controlling the quantity of the hydraulic fluid from the main hydraulic pumps depending on operational speed of an actuator in accordance with this invention.

Referring to FIG. 6 which is a flow chart showing the control method for automatically controlling the quantity of the hydraulic fluid in case of the overload occurring on the actuators in accordance with this invention, the controller 24 determines at a first inquiry step 62 whether the actuators 6, 8, 10, 12, 14 and 16 are driven. If the actuators are driven, the controller performs next step 63 wherein it receives electric signals corresponding to respective operational speed $V_i$ of the actuators 6, 8, 10, 12, 14 and 16 from the positional sensors 23a to 23f, while the controller 24 simply stops the process if the actuators are not driven. The controller 24 performs a next inquiry step 64 wherein it is determined whether the actuators are normally operated. I f the actuators are not normally operated, it is considered that there may be an overload occurring on an actuator. Thus, the controller 24 performs a step 65 wherein it determines whether the operational speed $V_i$ of the actuator is not exceeding $\frac{1}{2}$ speed of a minimum operational speed Vmin of the actuator, said minimum operational speed Vmin occurring when the actuator is supplied with a minimum quantity of the hydraulic fluid Qmin from the main hydraulic pumps. If the operational speed $V_i$ of the actuator is not exceeding $\frac{1}{2}$ speed of the minimum operational speed Vmin of the actuator, it is considered that there is an overload on the actuator. In result, the controller performs a next step 66 wherein it outputs a minimum current value imin to the wobbling angle control valves 19a and 19b in order to minimize the wobbling angles of the main pumps 3 and 4. Thus, the main pumps 3 and 4 each outputs a minimum quantity of fluid flow to the actuator. Thereafter, the controller 24 accomplishes a cycle of control process. However, If the operational speed $V_i$ of the actuator is exceeding $\frac{1}{2}$ speed of the minimum operational speed Vmin of the actuator, the controller 24 simply stop the control process.

On the other hand at the step 64, if the actuators are normally operated, it is considered that there may be no overload on an actuator. Thus, the controller 24 performs another next inquiry step 68 wherein it is determined whether the operational speed $V_i$ of the actuator is equal to or exceeds a returnable speed, for example $\frac{3}{4}$ speed of the minimum operational speed Vmin of the actuator. If the operational speed $V_i$ of the actuator is less than $\frac{3}{4}$ speed of the minimum operational speed Vmin, it is considered that the actuators can not be returned. Thus, the controller 24 stops the control process. However, if the operational speed $V_i$ of the actuator is equal to or exceeds $\frac{3}{4}$ speed of the minimum operational speed Vmin, the controller 24 performs a step 69 wherein it outputs an electric control signal to the wobbling angle control valves 19a and 19b in order to allow the main pumps 3 and 4 to output the quantity of fluid flow $Q_i$ according to the manipulation values $\Theta_i$ of the control levers/pedals 21. Then, the controller 24 accomplishes a cycle of the control process.

As described above, the control system of this invention provides a method for automatically controlling the quantity of the hydraulic fluid supplied to the swing motor in which in case of swinging operation for driving the swing motor in order to turn the upper frame with respect to the lower frame, the first hydraulic pump is automatically controlled by the controller in order to optimally output hydraulic fluid to timely correspond to starting of the practical swinging operation of the swing motor. Thus, the control system of this invention provides an advantage in that a hydraulic fluid loss in case of a swinging operation can be reduced as much as, and a smooth and rapid swinging operation can be accomplished by a simple manipulation for the swing motor control lever without occurrence of mechanical shock on the main pump or the swing motor.

In addition, the control system of this invention provides a control method for controlling the main pumps in order to output minimum quantity of fluid flow Qmin in case of sensing an abnormal operational speed, for example a speed not exceeding ½ speed of the minimum operational speed Vmin of the actuator occurring when the actuator is supplied with the minimum quantity of the hydraulic fluid Qmin from the main hydraulic pumps, occurring on the actuators due to an overload, but output a normal quantity of fluid flow $Q_i$ in order to allow the actuators to be normally operated in case sensing a returnable speed, for example a speed exceeding ¾ speed of the minimum operational speed Vmin. Thus, the control system of this invention provides an advantage in that the driving power for driving the engine is efficiently prevented from being lost due to an overload occurring on the actuators.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. In an apparatus for automatically controlling quantity of hydraulic fluid of an excavator comprising a plurality of actuators comprising a boom cylinder for actuating a boom, a dipper cylinder for actuating a dipper stick, a bucket cylinder for actuating a bucket, a swing motor for swinging an upper frame of the excavator with respect to a lower frame thereof and travelling motors for travelling said excavator; an electronic controller for controlling operation of said actuators; main hydraulic pumps for supplying hydraulic fluid to said actuators; a sub-hydraulic pump for supplying pilot hydraulic fluid to said actuators; a plurality of directional control valves each connected to said main hydraulic pumps and said electronic controller for controlling operational direction of said actuators and also quantity of said hydraulic fluid flow; pilot valve blocks adapted to controllably move spools of said directional control valves in accordance with electric control signals outputted from said electronic controller; wobbling angle control valves electrically connected to the controller and operably connected to the main pumps for controlling wobbling angles of the main hydraulic pumps in order to control said quantity of hydraulic fluid flow outputted therefrom; positional sensors provided at respective actuators in order to sense positional displacement values of said actuators; control levers/pedals for outputting respective electric signals corresponding to handling values for actuators to the controller; and a plurality of amplifiers electrically connected to the controller and said pilot valve blocks and said wobbling angle control valves, respectively, for amplifying electric signals outputted from said controller to said pilot valve blocks and said wobbling angle control valves; said electronic controller comprising:

a CPU for processing input signals in order to output control signals;

an analog/digital signal converter electrically connected to said CPU for converting input analog signals corresponding to manipulation values applied from the control levers/pedals to the controller into digital signals;

an analog/digital signal converter/counter electrically connected to said CPU for converting and counting an input signal corresponding to a swinging positional value of the swing motor applied from a positional sensor of the swing motor;

first and second digital/analog signal converters electrically connected to said CPU for converting first and second digital control signals from the CPU into first and second analog control signals for controlling the spools of the directional control valves of the actuators in accordance with the manipulating values of the control levers/pedals;

a third digital/analog signal converter electrically connected to said CPU and said wobbling angle control valves for converting third digital control signals received from the CPU into third analog control signals to be received by said wobbling angle control valves for controlling said wobbling angle control valves so that said main hydraulic pumps provide a variable additional output quantity of fluid flow and a target output quantity of fluid flow; and signal amplifying parts electrically connected to the first, second, and third digital/analog signal converters, respectively.

* * * * *

UNITED STATES PATENT AND TRADEMARK OFFICE

CERTIFICATE OF CORRECTION

PATENT NO. : 5,434,785
DATED : July 18, 1995
INVENTOR(S) : Song Myeong-hun, et al.

It is certified that error appears in the above-indentified patent and that said Letters Patent is hereby corrected as shown below:

Column 1, line 12;
"control led" should be –controlled–.

Column 1, line 24;
"travel ling" should be –travelling–.

Column 2, line 67;
"Vain" should be –Vmin–.

Column 3 line 22;
"travel ling" should be --traveling--.

Column 3, line 56;
"tile" should be –the–.

Column 5, line 62;
"drawl" should be –drawing–.

Column 6, line 6;
"tile" should be –the–.

UNITED STATES PATENT AND TRADEMARK OFFICE

CERTIFICATE OF CORRECTION

PATENT NO. : 5,434,785

DATED : July 18, 1995

INVENTOR(S) : Song Myeong-hun, et al.

It is certified that error appears in the above-indentified patent and that said Letters Patent is hereby corrected as shown below:

Column 6, line 47;
"i n the" should be –in the–.

Column 9, line 63;
"$W_{WS}$" should be –$W_{SW}$"–.

Column 10, line 41;
"imin" should be –Imin–.

Signed and Sealed this

Sixteenth Day of January, 1996

*Attest:*

*Attesting Officer*

BRUCE LEHMAN

*Commissioner of Patents and Trademarks*